US005961268A

United States Patent [19]

Jäger

[11] Patent Number: 5,961,268

[45] Date of Patent: Oct. 5, 1999

[54] METHOD AND DEVICE FOR ADHESIVE BINDING OF PRINTED PRODUCTS

[75] Inventor: Erich Jäger, Frauenfeld, Switzerland

[73] Assignee: Ferag AG, Hinwil, Switzerland

[21] Appl. No.: 08/820,441

[22] Filed: Mar. 12, 1997

[30] Foreign Application Priority Data

Mar. 25, 1996 [CH] Switzerland ..... 0769/96

[51] Int. Cl.[6] ..... B42C 5/00; B42C 5/04

[52] U.S. Cl. ..... 412/1; 412/6; 412/8; 412/22; 412/29; 412/32

[58] Field of Search ..... 412/1, 6, 8, 22, 412/29, 32

[56] References Cited

U.S. PATENT DOCUMENTS 2,277,266 3/1942 Zahnhiser ..... 15/21
4,373,985 2/1983 Glendening ..... 412/29
5,193,851 3/1993 Honegger ..... 281/15.1

FOREIGN PATENT DOCUMENTS 0 158 493 10/1985 European Pat. Off. .
0 538 198 4/1993 European Pat. Off. .
2096945 10/1982 United Kingdom .

*Primary Examiner*—Willmon Fridie, Jr.
*Assistant Examiner*—Mark T. Henderson
*Attorney, Agent, or Firm*—Walter C. Farley

[57] ABSTRACT

According to the inventive method for joining product parts by means of a glued spine, the juxtaposed edges of the stacked product parts which form the spine area (2) of the product in process are pre-treated with a tearing tool (4) e.g. with a rotating brush. The method is especially advantageous for joining multi-layer product parts with multi-layer folded edges to be joined, whereby the folded edges are torn up by the tearing tool (4) to a depth at least reaching the innermost layer. The inventive method is also applicable in the sense of stitching, for joining the individual layers of one single product part with one multi-layer folded edge.

10 Claims, 4 Drawing Sheets

Fig.2
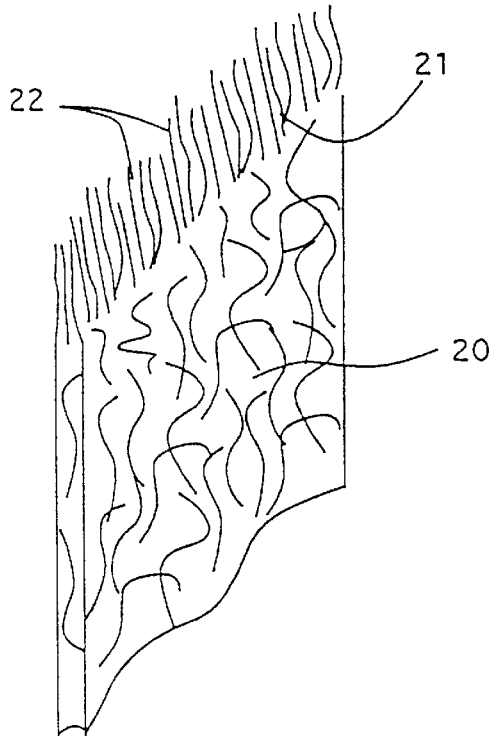
Fig.3
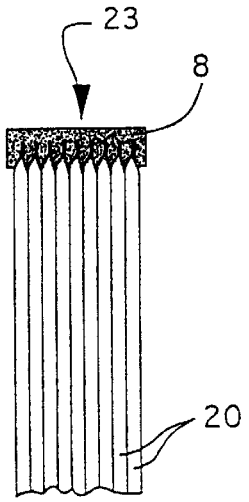
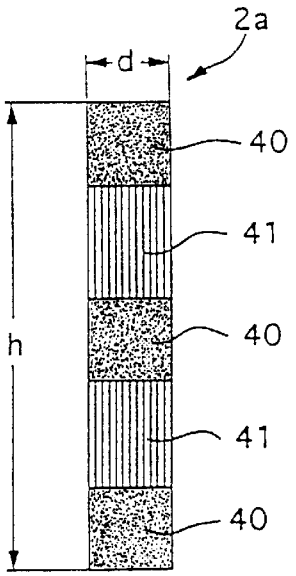
Fig.4a
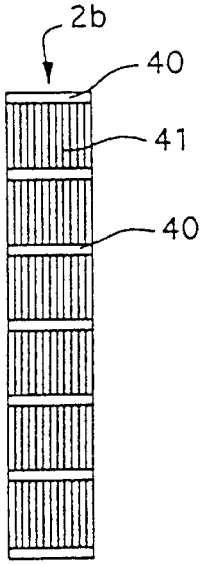
Fig.4b
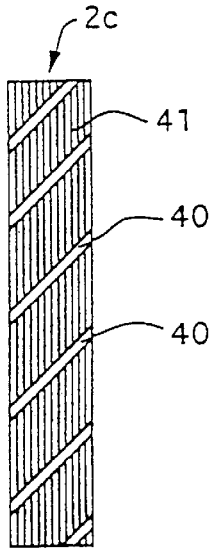
Fig.4c

METHOD AND DEVICE FOR ADHESIVE BINDING OF PRINTED PRODUCTS

FIELD OF THE INVENTION

The invention lies in the field of the post-printing processing of printed products and concerns a method and a device for producing multi-page printed products with a glued spine from one or more stacked product parts wherein the spine area is prepared and an adhesive is applied thereto.

BACKGROUND OF THE INVENTION

The inventive method and the device for carrying out the method are applicable for adhesive binding, i.e. for joining with the help of an adhesive a plurality of stacked product parts on one stack surface for producing a finished product with a glued spine, whereby one product part may be one single sheet, a sheet folded once or several times or several sheets folded once and positioned inside each other. The products consist of fibrous material, e.g. paper. The products produced by means of adhesive binding are e.g. newspapers, brochures, books or similar products. The glued spine may additionally be covered with a spine strip which may be part of the finished product.

As long as single sheets or product parts which are once folded, i.e. two pages connected by a folded edge, are to be joined by a glued spine this can be carried out without great expense. It is sufficient to introduce the adhesive between the product parts such that these on the one hand are held together sufficiently, and on the other hand such that opening of the finished product is not impaired too much, whereby a minimal impediment cannot be avoided.

If however, multi-layer product parts which are folded several times, e.g. several times folded sheets or a plurality of sheets positioned inside each other, are to be joined by means of a glued spine this causes a further problem which must be solved: in addition to the fact that the edges or folded edges of the product parts must be joined, the adhesive action must also reach the inner edges of the folds through the outer edges such that the inner parts of each product part are also joined to the glued spine.

According to the state of the art glued spines on products consisting of multi-layer product parts are produced by milling off the spine area formed by the folded edges of the multi-layer product parts to such a depth that all folded edges (possibly not including the innermost folded edge) are milled off and thus actually a stack of single sheets is formed which is then glued in the same way as any stack of single sheets. Between milling and gluing, usually dust is removed from the spine area. These methods are commonly used although the required devices are rather costly and they comprise at least two disadvantages: firstly large amounts of waste in form of shavings is produced and must be sucked away, secondly by milling off the folded edges, the individual pages of each product part lose their inherent connection given by the folded edge and therefore the adhesive connection must be considerably stronger than a similar connection for pages which are at least partly connected by folded edges.

The two method disadvantages mentioned above are compensated by other known methods in which not the complete spine area is milled but only parts of it which parts expand over the complete width of the spine area (in the direction of the thickness of the finished product) and are normally spread regularly over the height of the spine (length of the edges which are to be joined by the glued spine). If such part areas are glued they have the same effect as staples or stitching thread with which sheets which are folded inside each other are also connected in specific points only. Between the glued portions, the folded edges are unchanged and thus the connection between two individual pages is maintained in the finished product and contributes to the stability of the end product.

Methods according to which multi-layer folded edges are drilled or punched and then glue is inserted into the openings lead to similar products. Such produced contact points (adhesive stitching) have the same effect as stitching and hold the individual layers of the product parts together such that these adhesively stitched product parts can then be joined with an adhesive spine in a following method step or integrated in the adhesive stitching step. Adhesive stitching methods are e.g. described in publications EP-0628429, EP-0664226 and EP-0662440. According to publication EP-390734 the adhesive is shot through the layers without the necessity of producing an opening with a corresponding tool.

Furthermore, the publications EP-390733 (or U.S. Pat. No. 5,350,268) and EP-409770 (or U.S. Pat. No. 5,193,851) describe a method in which a plurality of once folded sheets is collected, whereby a momentary outermost folded edge is treated with glue between the individual collecting steps such that the folded edge positioned on it in the next collecting step adheres to it thus forming product parts similar to stitched product parts which are then joined by a glued spine in the same way as once folded single sheets.

SUMMARY OF THE INVENTION

All described methods for the production of glued spines for joining product parts with multi-layer folded edges are costly and can be used for specific product parts only. Therefore, it is the object of the invention to create a method and a device for joining product parts by means of a glued spine with which method and device particularly product parts with multi-layer folded edges can be joined in a considerably more simple manner. Method and device are to be suitable for high-performance processing. Furthermore they are to be as universally applicable as possible, i.e. they are to be equally advantageously applicable for joining individual sheets, for joining once folded single sheets (with a one-layer folded edge each) or for joining the individual layers of one product part with one multi-layer folded edge only. The resulting products of all applications are to be at least equal in what regards quality to the products produced according to the state of the art and are to be in particular openable at least as well.

The inventive method is based on treating the stacked product parts to be adhesively joined with a tearing or roughing tool (in contrast to a cutting tool) such that multi-layer folded edges are ripped open at least in specific areas. By the tearing or roughing, edge portions are pretreated for gluing, which edge portions consist of fibers which adhere only partly in the compound of the paper and protrude over the actual paper edge. These fibers not only anchor the sheets in the glue of the glued spine but also form a glued region which is thinner and more flexible than the whole paper layer, such that the finished product can be opened more easily.

By an appropriate choice of the tearing or roughing tool and by a corresponding adjustment of the relative movement between the roughing tool and the edges to be treated, the properties of the treated edges to be joined adhesively are influenced advantageously such that the fibers of the pretreated edge portion protrude as completely and as ordered as possible over the edge of the paper.

BRIEF DESCRIPTION OF THE DRAWINGS

The inventive method and the inventive device are now described more in detail in connection with the following drawings wherein:

FIG. 2 is a perspective schematic view on a larger scale, of an edge of a sheet treated with a tearing tool;

FIG. 3 enlarged partial view, in section, of a glued spine produced according to the inventive method;

FIGS. 4*a* to 4*c* are schematic end elevation of three different examples of glued spines produced according to the inventive method;

DESCRIPTION OF PERFERRED EMBODIMENTS

Figure 1:
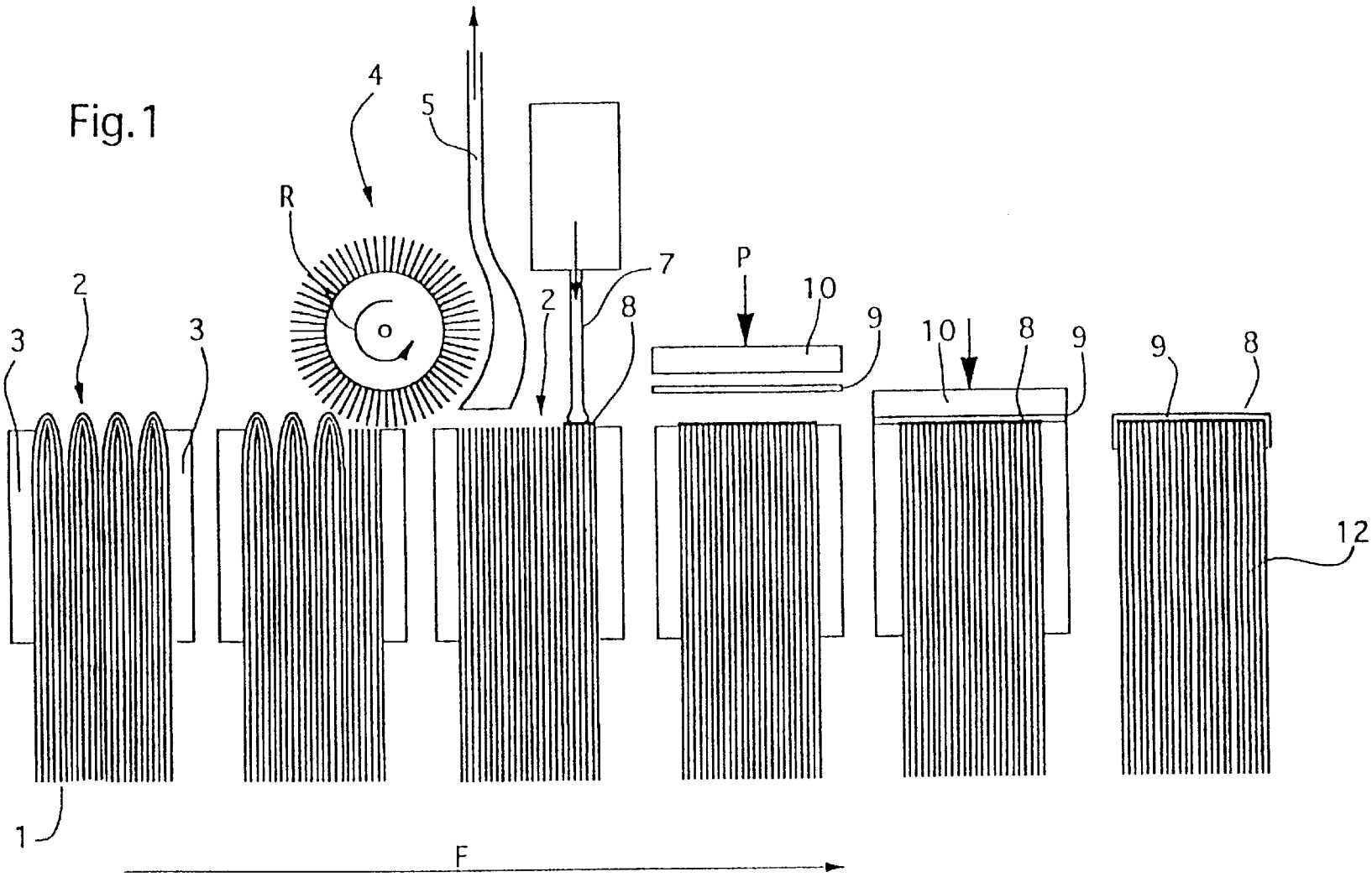
FIG. 1 is a schematic side elevation showing successive stages of the production of an product in accordance with the present invention with a glued spine which product is made from product parts having several pages each.

FIG. 1 shows the inventive method diagrammatically in a representation of successive phases of a product with a glued spine being produced which product consists of a plurality of product parts with several pages each (consisting of three sheets folded inside each other). The Figure can also be understood as a diagrammatic snapshot of a continuous process in which a plurality of products being processed is conveyed past different processing tools whereby the spine area of each product is pre-treated, an adhesive is applied to it, a spine strip is fitted to it and is pressed to it.

A stack 1 of e.g. four folded product parts held by suitable holding means 3 is supplied to the inventive method, whereby the stacked product parts with adjacent folded edges form a spine area 2 to be processed to a glued spine. The stack 1 of product parts is conveyed past a tearing or roughing tool 4 (e.g. a rotating brush) for the pre-treatment of the spine area 2, whereby the tearing tool 4 is arranged such that its effect has a depth which reaches at least down to the innermost layer of the folded edges.

By the effect of the tearing or roughing tool the edges arranged in the spine area are torn if they are folded edges or they are transformed from cut edges into torn edges if they are not folded edges.

The rotating tool is advantageously driven (arrow R) such that it works in the same direction as the product is conveyed (direction F) production (down grinding). By this direction of rotation the fibers of the torn edge areas are combed out of the edge by which the advantageous effect is increased (see also FIGS. 2 and 3 and the corresponding description).

Fibers removed from the spine area by tearing and combing are sucked off and/or are removed mechanically from the tool 4 with suitable means 5.

From the stack I of folded product parts, a stack of product parts with ripped open edges forming a spine area 2, e.g. a stack of individual sheets with torn edges, is produced by the pre-treatment with the tearing tool. With suitable means 7 an adhesive 8 is applied to this pre-treated spine area 2 with which adhesive the ripped edges are joined in a glued spine. A spine strip 9 may be applied to the adhesive and pressed (arrow 10) with suitable pressing means 10. For hardening or drying of the adhesive 8, heat may have to be applied to it.

Variants of the spine strip 9 shown in FIG. 1 are cover sheets or pairs of cover sheets reaching across the spine area. The covering of the spine with a spine strip is a measure to improve the aesthetic value of the finished product. Of course, this measure can also be left away such that the glued spine is visible on the finished product.

From FIG. 1 it can clearly be seen that the inventive method is not only applicable for joining a plurality of product parts but also for joining the individual layers of one multi-layer product part, whereby the adhesive joint has the same function as stitching or staples.

The inventive method is characterized by the pre-treatment of the spine area 2 of the stack of product parts, the other steps for forming a glued spine being known. After pre-treatment with a tearing or roughing tool no further pre-treatment steps are necessary, i.e. that after the tearing or roughing pre-treatment the adhesive can be applied immediately. The end product of the method is a multi-page printed product 12.

FIG. 2 shows a sheet 20 of paper or a different fibrous material on a considerably larger scale in the region of a torn edge 21 which is protruded by fibers 22 combed outward over the edge, whereby the fibers in the sheet 20 itself are substantially inordinate. By tearing off a part of the fibers from the edge region and by ordering the remaining fibers in this region, an edge region which tapers outwardly, as shown in FIG. 2, is formed.

FIG. 3 shows a plurality of sheets 20 in a section perpendicular to the main surfaces of the sheets which sheets 20 are held together by a glued spine 23. From this Figure it can be seen clearly that the adhesive 8 holds together substantially the tapering edge regions of the sheets 20. Due to the tapering these are more flexible than cut edges, i.e. not tapering edge regions, and thus facilitate the opening of the bound product. Due to the orientation of the fibers (see FIG. 2) in the edge regions joined in the glued spine, the mechanical rigidity of this edge region is nonetheless not substantially reduced such that tearing off a sheet from the glued spine is not more probable than when cut edges are joined.

FIGS. 4*a* to 4*c* show examples of different spine areas 2*a* to 2*c* as they can be produced according to the inventive method. Spine areas 2*a* to 2*c* have a width d and a height h, whereby the edges of the product parts are parallel to the height h. Spine area 2*a* according to FIG. 4*a* comprises a pattern of bound portions 40 alternating with not bound portions 41. The bound portions expand over the whole width of the spine area and over a part of its height. In these portions the edges of the product parts are pre-treated and joined adhesively. In the not bound portions 41 the edges of the product parts are unchanged, i.e. if they are folded edges the folded parts are still connected to each other in these portions which contributes to the stability of the bound product.

The spine area 2*b* according to FIG. 4*b* shows more and narrower bound portions 40, but is not principally different from the spine area 2*a* according to FIG. 4*a*. FIG. 4*c* also shows a spine area 2*c* with narrow bound areas 40 which are not parallel to the width d of the spine but oblique angled to it. Glued spines according to FIG. 4*c* are advantageously flexible and produceable with a minimum of adhesive. Variants with crossing oblique bound portions are also possible.

Figure 5:
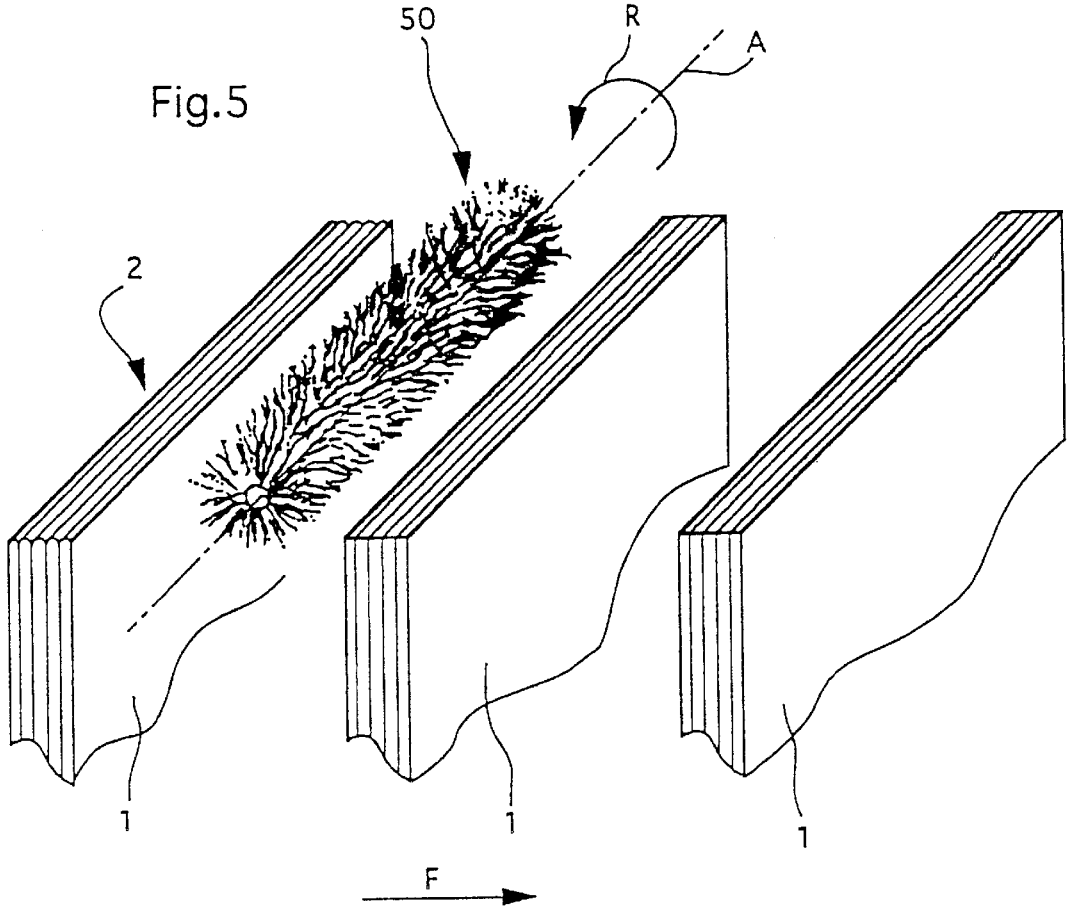
FIG. 5 perspective view of an embodiment of the inventive device for carrying out the inventive method, with rotating brushes as tearing tool.

FIG. 5 shows an embodiment of a device for carrying out the inventive method in a representation restricted to the most substantial parts. This device comprises a tearing tool in form of a rotating brush 50 the axial expansion of which is substantially the same as or larger than the height of the spine of the stack 1 of product parts conveyed past it with the help of corresponding conveying means (not shown) in a conveying direction F. The brush 50 is arranged such that its axis A is orientated substantially parallel to the products to be treated which are conveyed past it and that the distance between the spine areas 2 of the supplied products 1 and the axis A of the brush is smaller than the radius of the brush, substantially by the depth of the folded edges (see FIG. 1). The direction of rotation R of the brush 50 is advantageously adjusted such that the brush works in the same direction as the product is conveyed (down grinding); however operation with opposite rotation is also possible (up grinding). Brush 50 is advantageously a wire brush.

The representation according to FIG. 5 concerns the pre-treatment of stacks 1 of product parts which are conveyed in a high performance conveying stream, i.e. with their main surfaces orientated perpendicular to the conveying direction F. For a pre-treatment of products conveyed with their main surfaces and heights of spines parallel to the conveying direction, the brush is to be orientated perpendicular to the heights of the conveyed spines. In any case, the axis of the rotating brush is to be arranged substantially perpendicular to the conveying direction.

Figure 6:
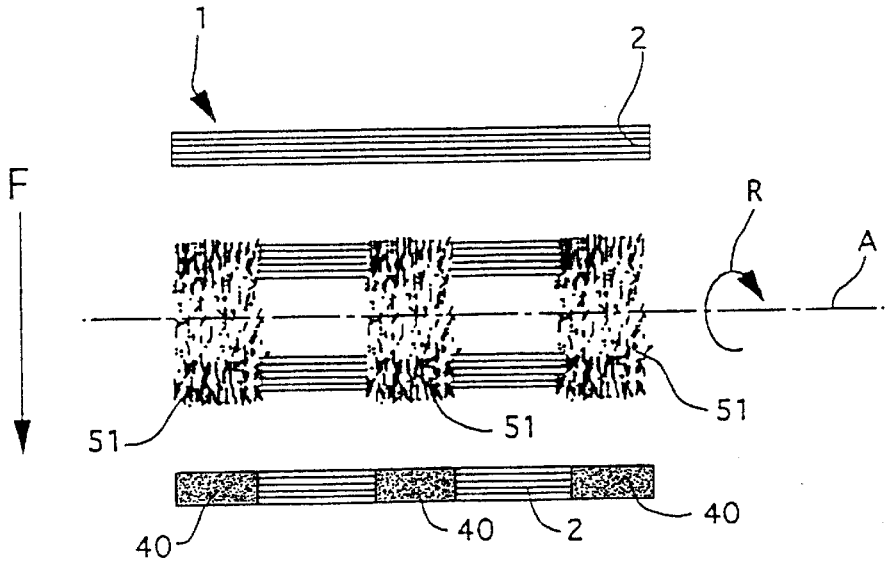
FIG. 6 schematic top plan view of a further embodiment of the inventive device with a plurality of rotating brushes as tearing tool and FIG. 7 schematic top plan view of a further embodiment of the inventive device with a plurality of cogged discs as tearing tool.

FIG. 6 shows a device with three coaxially arranged rotating brushes 51 in a bird's eye view past which brushes the spine areas 2 of stacks 1 of product parts are conveyed and are pre-treated in three portions 40.

Figure 7:
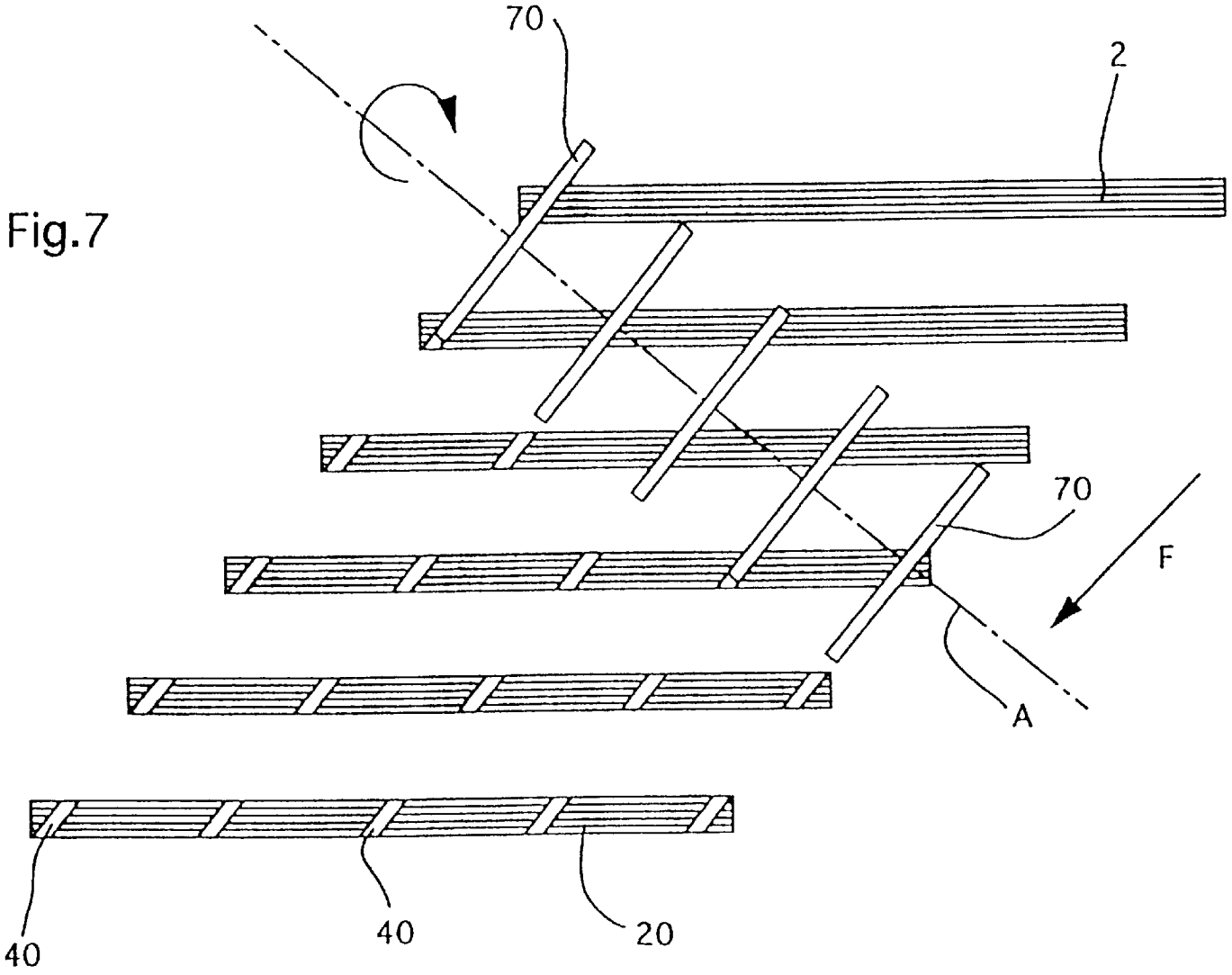

FIG. 7 also shows a device for producing glued spines according to FIG. 4*c* in a bird's eye view. For the tearing pre-treatment of the spine areas 2 a plurality of tools 70 in the form of discs is provided, e.g. cogged discs, which are arranged coaxially or with parallel axes A, whereby the conveying direction F runs perpendicular to the axis A of the tools and the heights of the spine areas 2 are orientated slanting to the discs 70.

FIGS. 5, 6 and 7 show, in a very simplified manner, devices applicable for pre-treatment of stacks 1 of product parts conveyed in a high-performance conveying stream (conveying direction F) in which devices spines 2 are treated with a substantially stationary tool past which they are conveyed. As mentioned above, products conveyed continuously in a different order can be pre-treated in an analogue manner. Also possible are arrangements in which substantially stationary products are treated with moved tools or arrangements in which tools and products carry out translatory movements, whereby there is a relative movement between product and tool.

I claim:

1. A method for producing a multi-page printed product having a glued spine, the method comprising the steps of providing a stack of one or more multi-page product parts, each product part having a spine area comprising a multilayer fold edge or a plurality of juxtaposed multilayer fold edges having an outermost and an innermost fold edge, the spine area having a length and a width, tearing the spine area of the multi layer fold edge or fold edges to the level of the innermost fold edges with a tearing or roughing tool, and applying adhesive to the torn spine area.

2. A method according to claim 1 wherein the tearing or roughing tool comprises one or more rotating brushes or cogged discs and including, during the tearing step, creating relative movement between the tearing or roughing tool and the spine area in a conveying direction to convey the spine area past the tearing or roughing tool.

3. A method according to claim 2 wherein contacting portions of the rotating brushes or cogged discs contact the spine area while moving in the same direction as the conveying direction.

4. A method according to claim 1 including tearing the spine area along full lengths of the product parts.

5. A method according to claim 1 including tearing the spine area at selected, spaced locations distributed along lengths of the product parts.

6. A method according to claim 5 wherein the selected locations extend across the width of the spine area at an oblique or a right angle.

7. A device for producing multi-page printed products having a glued spine comprising the combination of a tearing or roughing tool;

means for holding a stack of one or more multi-page product parts, each product part having a spine area comprising a multilayer fold edge or a plurality of juxtaposed multilayer fold edges having an outermost and an innermost fold edge, means for creating relative movement between said tearing or roughing tool and said holding means so that said tool acts on said spine area to a depth of said innermost fold edge; and means for applying an adhesive to said acted-on spine area.

8. A device according to claim 7 wherein said tearing or roughing tool comprises a plurality of rotationally driven brushes or cogged discs, and wherein said means for creating relative movement moves said tool relative to said product parts held by said holding means.

9. A device according to claim 7 wherein said tool rotates in a substantially stationary position and said means for holding moves said stack past said tool so that said tool contacts said spine area of said stack.

10. A device according to claim 9 wherein said tool comprises a drive rotating said tool so that a part of said tool in contact with said spine area moves in the same direction as said stack.

* * * * *